US006991559B2

(12) United States Patent
Yabu

(10) Patent No.: US 6,991,559 B2
(45) Date of Patent: Jan. 31, 2006

(54) GOLF CLUB HEAD

(75) Inventor: Masanori Yabu, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/455,528

(22) Filed: Jun. 6, 2003

(65) Prior Publication Data

US 2003/0228928 A1 Dec. 11, 2003

(51) Int. Cl.
*A63B 53/04* (2006.01)

(52) U.S. Cl. ..... 473/332; 473/342; 473/345; 473/350; 473/409

(58) Field of Classification Search ..... 473/332, 473/345–346, 342, 349–350, 409
See application file for complete search history.

(56) References Cited

U.S. PATENT DOCUMENTS 4,252,262 A * 2/1981 Igarashi ..... 228/174
4,928,965 A 5/1990 Yamaguchi et al.
4,928,972 A * 5/1990 Nakanishi et al. ..... 473/332
5,766,092 A * 6/1998 Mimeur et al. ..... 473/329
6,361,455 B1 * 3/2002 Takemura ..... 473/378
6,368,236 B1 * 4/2002 Sullivan et al. ..... 473/377
6,383,644 B2 * 5/2002 Fuchs ..... 428/424.8
6,435,981 B2 * 8/2002 Naruo et al. ..... 473/329
6,688,989 B2 * 2/2004 Best ..... 473/332
6,709,345 B2 * 3/2004 Iwata et al. ..... 473/291
2002/0049094 A1 * 4/2002 Kosmatka ..... 473/329
2003/0199331 A1 * 10/2003 Stites, III ..... 473/290

FOREIGN PATENT DOCUMENTS

GB 2028353 * 10/1979
JP 2001-170222 A 6/2001

* cited by examiner

*Primary Examiner*—Stephen Blau
(74) *Attorney, Agent, or Firm*—Birch, Stewart, Kolasch & Birch, LLP

(57) ABSTRACT

A golf club head comprises a face plate having a back face and a front face forming a club face for hitting a ball; a clubhead main body to which the face plate is attached, the clubhead main body comprising a sole portion and a backside wall portion, the backside wall portion extending upward from the sole portion, leaving a space from said back face; and an insert made of an elastic material and interposed between the back face of the face plate and the backside wall portion.

14 Claims, 9 Drawing Sheets

GOLF CLUB HEAD

BACKGROUND OF THE INVENTION

The present invention relates to a golf club head, more particularly to a backside structure capable of making the center of gravity of the club head lower and deeper and improving the restitution coefficient of the clubface.

It has been known in the art that lowering the sweet spot is preferable for the average golfers because the balls become liable to hit above the sweet spot, and the ball lunching angle is increased and at the same time the backspin is lessened, and as a result, the traveling distance of the ball is increased. Further, making the center of gravity deeper is also preferable because the directionality may be improved.

On the other hand, Japanese patent No. 2130519 (corresponding to U.S. Pat. No. 4,928,965) teaches improving the restitution coefficient of the clubface by matching the clubface with the golf balls with respect to the frequency at which the mechanical impedance in the primary mode vibration becomes minimum.

Indeed, the frequency of the clubface can be adjusted by changing the material of the face plate, the thickness of the material, the thickness distribution, heat treatment (in case of metal) and the like. However, the adjustment, especially fine adjustment is rather difficult. Further, adjustments on the finished club heads are almost impossible.

SUMMARY OF THE INVENTION

It is therefore, an object of the present invention to provide a golf club head in which, by providing a backside wall and by disposing an elastic insert between the backside wall and the back face of a face plate, the center of gravity of the club head is made lower and deeper while allowing proper flexure of the face plate at impact to improve the restitution coefficient of the clubface to increase the traveling distance of the struck ball.

According to the present invention, a golf club head comprises a face plate having a back face and a front face forming a club face for hitting a ball, a clubhead main body to which the face plate is attached, the clubhead main body comprising a sole portion and a backside wall portion, the backside wall portion extending upward from the sole portion, leaving a space from said back face, and an insert made of an elastic material and interposed between the back face of the face plate and the backside wall portion.

DESCRIPTION OF THE PREFERRED EMBODIMENTS

Embodiments of the present invention will now be described in detail in conjunction with the accompanying drawings.

Figure 1:
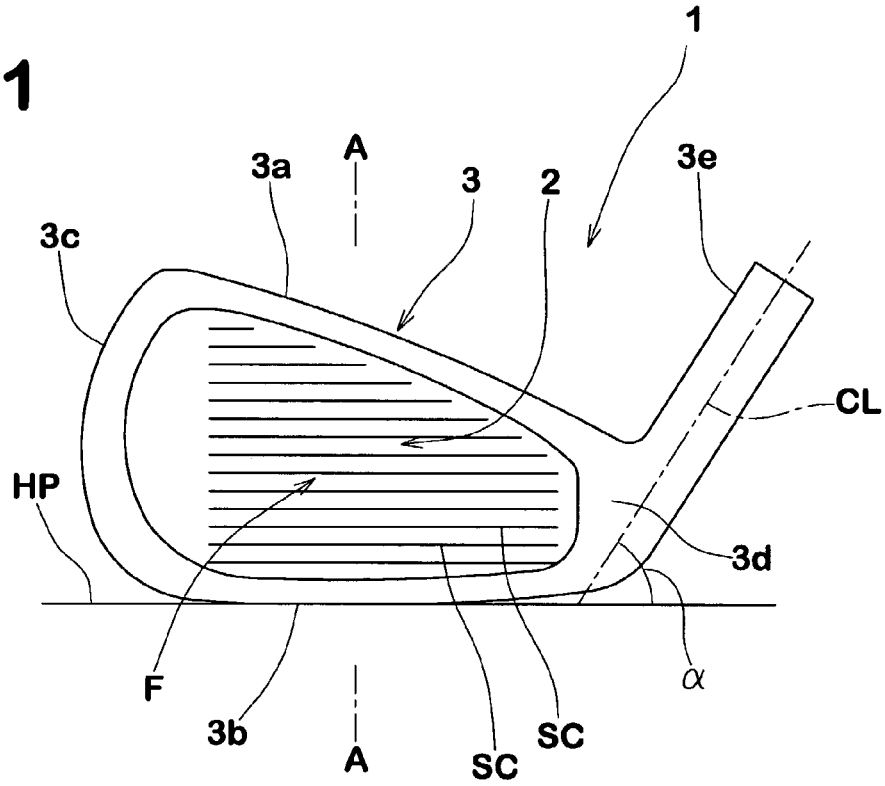
FIG. 1 is a front view an iron-type golf club head according to the present invention.
Figure 2:
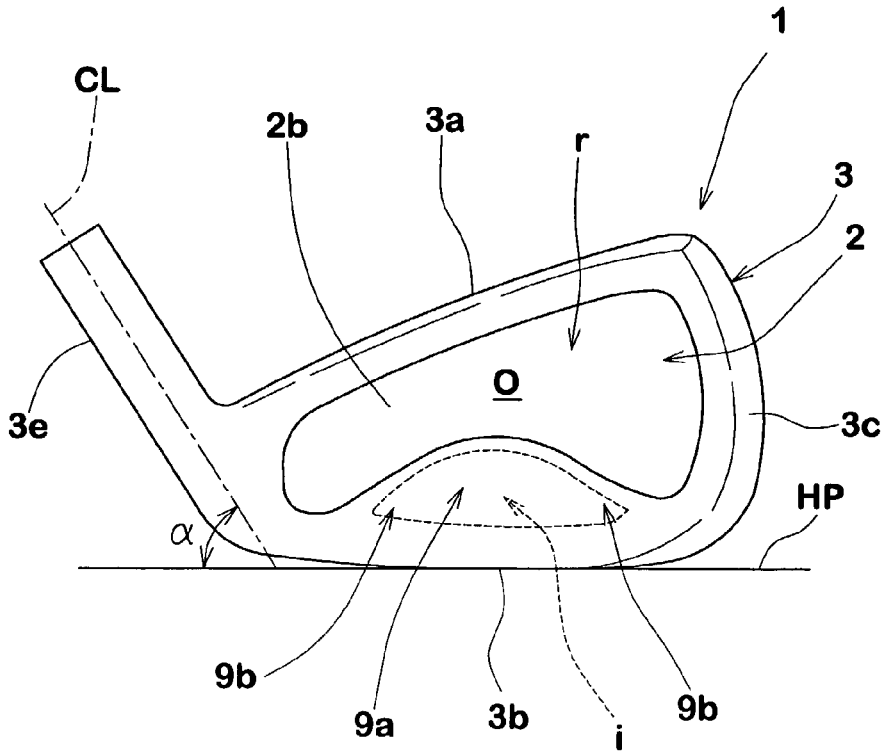
FIG. 2 is a rear view thereof.
Figure 5:
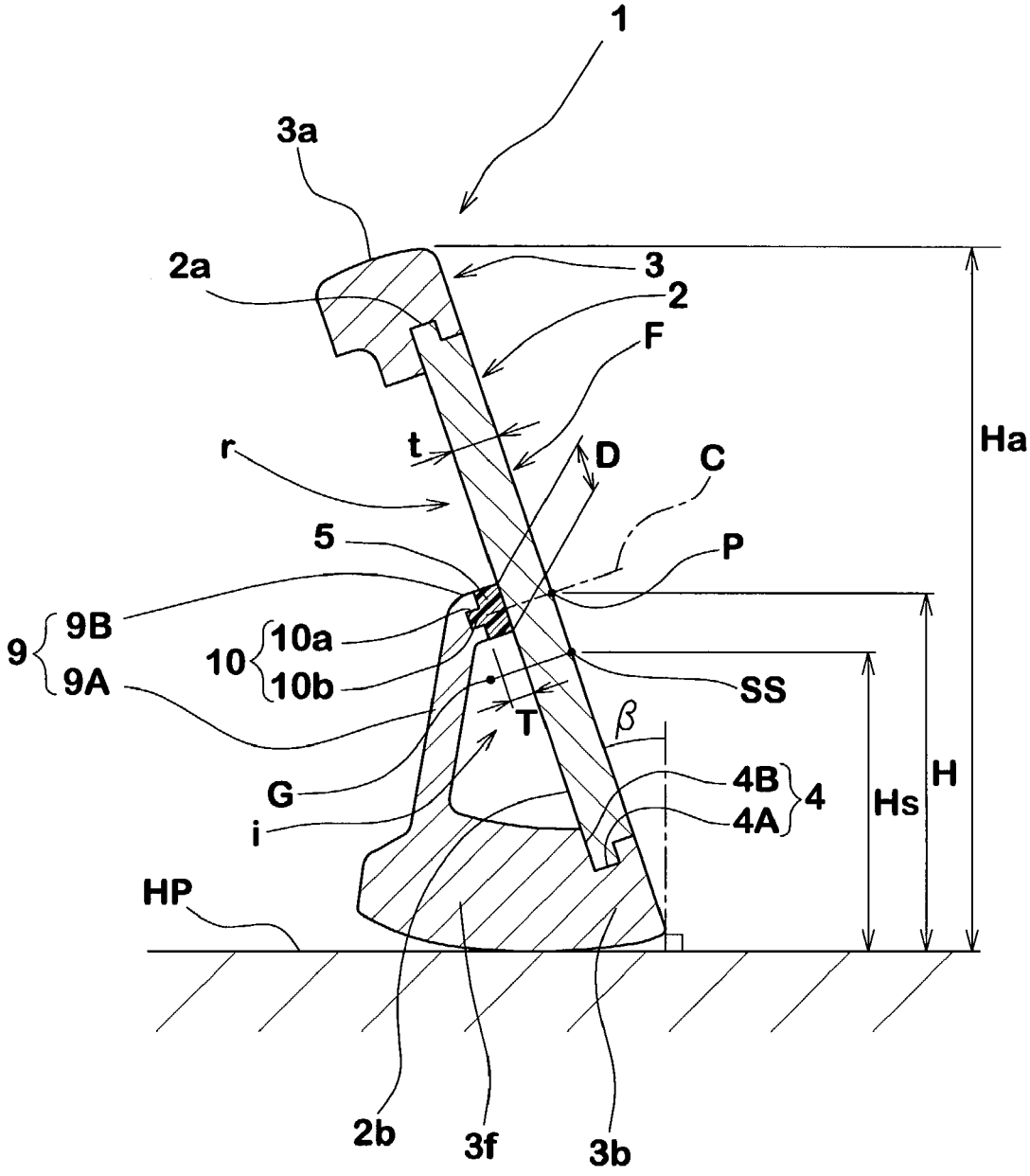
FIG. 5 is a sectional view of the head taken along a line A—A in FIG. 1.

In the drawings, golf club head 1 according to the present invention is an iron-type club head comprising a clubhead main body 3 and a face plate 2 attached thereto. FIGS. 1, 2 and 5 show the standard state of the golf club head 1 in which the head is set on a horizontal plane HP with its lie angle $\alpha$ and loft angle $\beta$.

The face plate 2 has a front surface (F), a back surface 2*b* and a circumferential side surface 2*a*. The front surface defines a major part of the club face F for hitting a ball. In this example, the front surface defines the entirety of the club face F.

AS the material of the face plate 2, various metal materials such as titanium alloys, pure titanium, maraging steels, aluminum alloys, amorphous alloys and stainless steels can be used. Further, fiber reinforced resins may be used too. However, preferably, metal materials having a relatively low Young's modulus such as a titanium alloy (e.g. Ti-6Al-4V) and a maraging steel (e.g. CUSTOM 465) are used.

To improve the rebound performance, it may be preferable that the Young's modulus of the face plate 2 is set in a range of from 70 to 200 GPa.

The face plate 2 in this example has a substantially constant thickness (t) over the entirety. This is however, not always necessary. The thickness (t) may be varied. In any case, it is preferable for the durability and rebound performance that the thickness (t) is set in a range of from 1.5 to 4.5 mm, more preferably 2.0 to 4.0 mm, still more preferably 2.0 to 3.5 mm.

The front surface of the face plate 2 or the club face F is substantially flat excepting unevenness which may be provided to increase the friction between the club face F and a ball. In this example, horizontal parallel face grooves SC are provided with this view.

The face plate 2 is attached on the front of the clubhead main body 3 using a face plate mount 4 formed on the clubhead main body 3.

The clubhead main body 3 comprises a top portion 3*a*, a sole portion 3*b*, a toe portion 3*c*, a heel portion 3*d* and a hosel 3*e*. The toe portion 3*c* is taller in height than the heel portion 3*d*, and the top portion 3*a*, sole portion 3*b*, toe portion 3*c* and heel portion 3*d* are circularly arranged to form a through hole (O) surrounded thereby. Thus, the through hole (O) has an opening at the front of the clubhead main body 3 and an opening at the rear of the clubhead main body 3. The hosel 3*e* is formed integrally with the heel portion 3*d* and provided with a shaft inserting hole. The central axis CL of the shaft inserting hole is utilized to set the club head with the lie angle $\alpha$.

For the clubhead main body 3, various metal materials such as stainless steels, carbon steels, pure titanium, titanium alloys, aluminum alloys, maraging steels and Ti—Ni based alloys may be used. But, preferably, a metal material whose specific gravity is larger than the face plate material is used. Specifically, a stainless steel (SUS630) is used in this embodiment. Therefore, the weight of the club head 1 shifts towards the peripheral part of the face portion and the sweet spot area is widened. In this embodiment, using a lost-wax precision casting method, the clubhead main body 3 is formed as an integral molding of the stainless steel.

Figure 3:
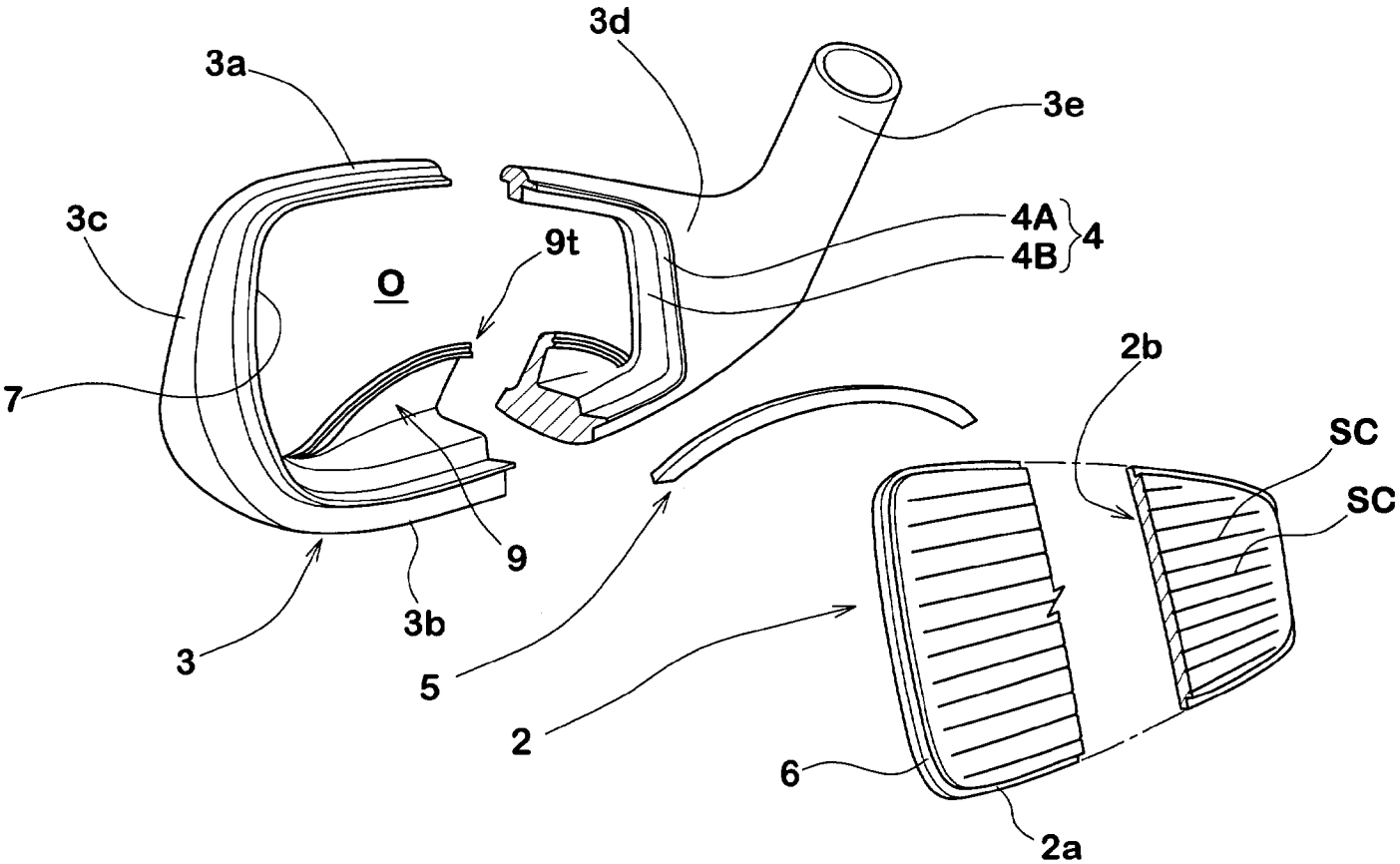
FIG. 3 is an exploded perspective view of the club head showing a face plate, a clubhead main body and an elastic insert.

The above-mentioned face plate mount 4 is to give support to the peripheral part of the face plate 2 and it is formed at the front end of the through hole (O). As shown in FIG. 3 and FIG. 5, the face plate mount 4 is defined by a side-support wall 4A and a back-support wall 4B which are formed continuously along the edge of the opening in a form like a stepped hole.

The side-support wall 4A gives side support to the face plate 2 by its inward surface which extends continuously through the portions 3*a*, 3*b*, 3*c* and 3*d* and comes into contact with the circumferential side surface 2*a* of the face plate 2.

The back-support wall 4B gives back support to the face plate 2 by its front surface which protrudes perpendicularly to the above-mentioned inward surface of the side-support wall 4A from the rear edge of the inward surface and extends continuously through the portions 3*a*, 3*b*, 3*c* and 3*d* so as to contact with the periphery part of the back surface 2*b*.

The shape of the face plate 2 is accommodated to the shape of the face plate mount 4, and the face plate 2 is fitted in the face plate mount 4 and fixed to the main body 3 by means of caulking, adhesive bonding, soldering, press fitting, welding or the like.

Figure 4A:
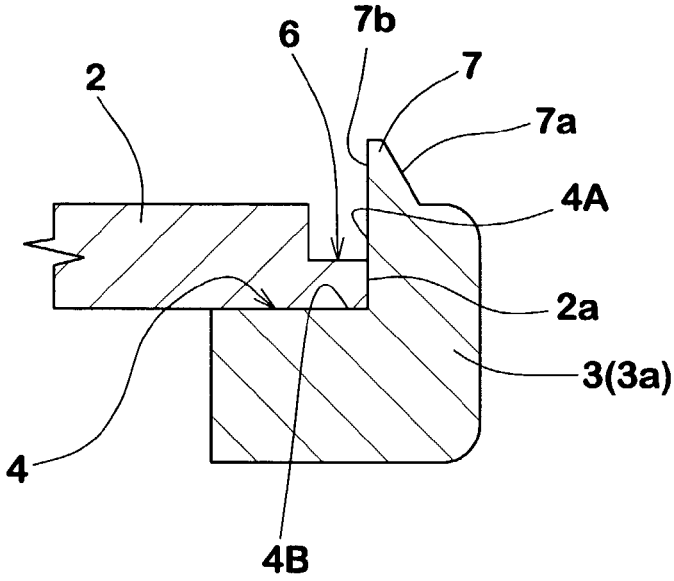
FIGS. 4*a* and 4*b* are enlarged cross sectional views for explaining a method of fixing the face plate to the clubhead main body.
Figure 4B:
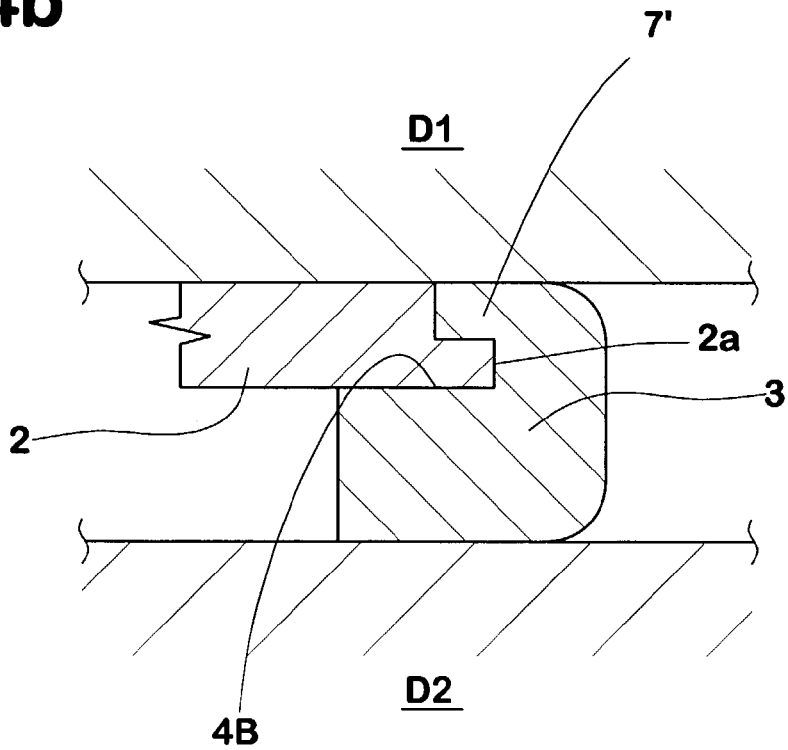

FIGS. 4*a* and 4*b* show a method of fixing the face plate 2 to the clubhead main body 3 by caulking. In this example, the front edge of the circumferential side surface 2*a* of the face plate 2 is cut away by a constant depth and a constant width, and as a result, a step 6 is continuously formed. FIG. 4*a* shows the face plate mount 4 before caulking. At this moment, the side-support wall 4A has a frontward extension 7 protruding from the front face of the clubhead main body 3. In this example, the frontward extension 7 has a trapezoidal sectional shape whose inner side 7*b* is aligned with the side-support wall 4A, and outer side 7*a* is inclined towards the inside or the center of the face plate mount from the back side to the front side of the clubhead main body 3. The face plate 2 is put in the face plate mount 4, and the head main body 3 is pressed between press dies D1 and D2 to cause the frontward extension 7 plastic deformation as shown in FIG. 4*b*, namely, the frontward extension 7 collapses into the step 6 to secure the periphery of the face plate 2 between the collapsed frontward extension 7' and back-support wall 4B.

In order to make the center G of the gravity deeper and lower, the sole portion 3*b* is, as shown in FIGS. 3 and 5, provided with a massive backward extension 3*f* forming the sole of the club head 1. Further, a backside wall 9 is provided. The backside wall 9 together with the backward extension 3*f* is formed as a part of the above-mentioned integral molding of the metal material (stainless steel in this example).

Figure 7:
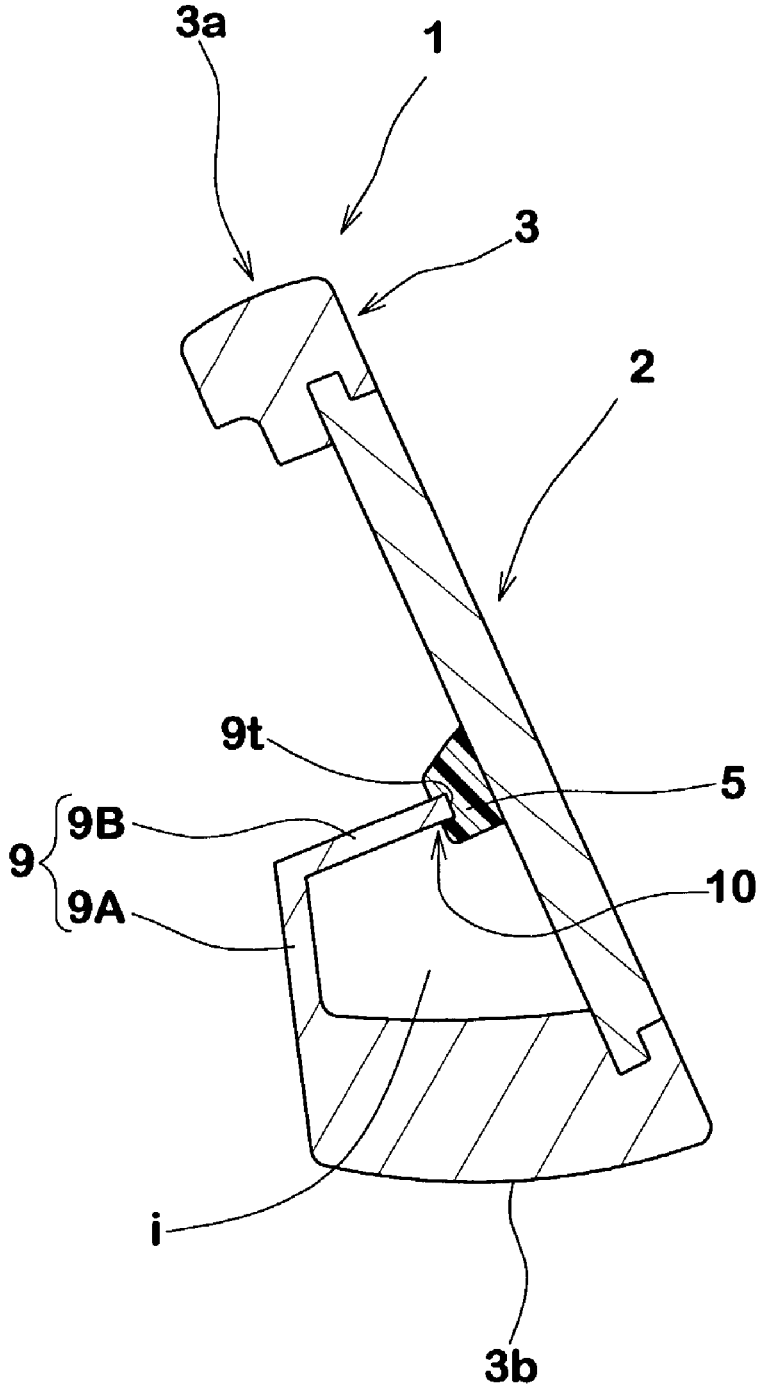
Figure 8:
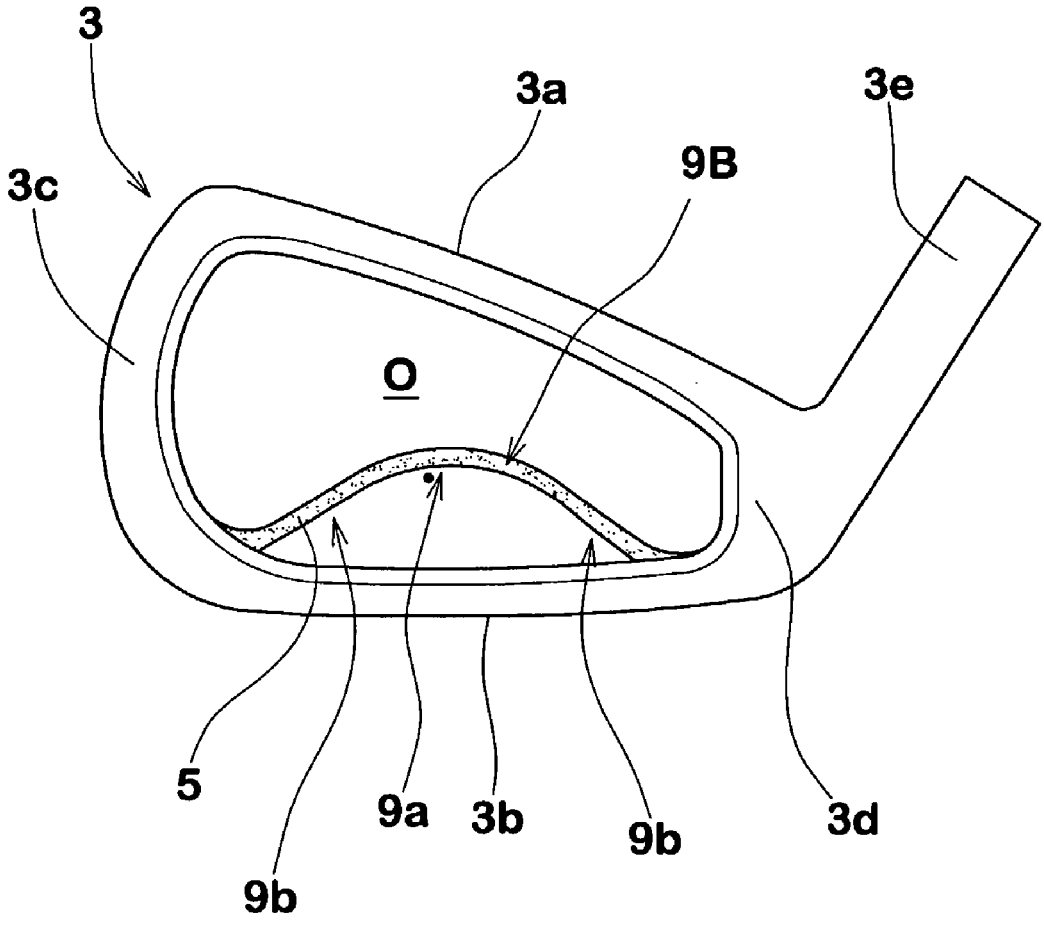
FIG. 8 is a front view of the clubhead main body of the embodiment shown in FIGS. 1–3.
Figure 9:
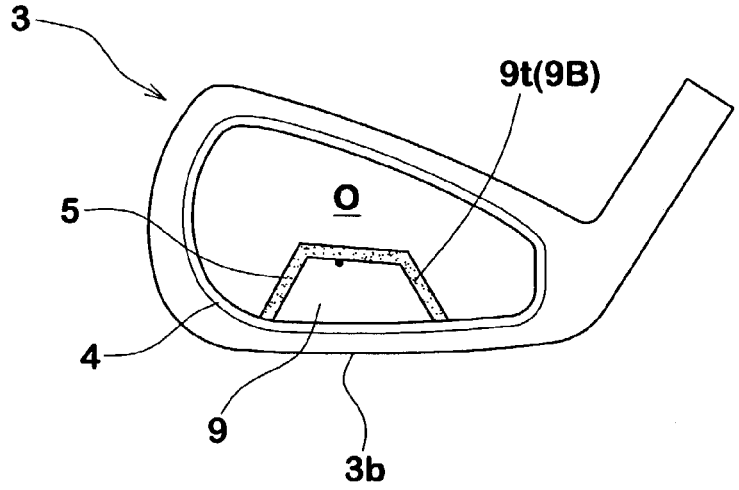
FIGS. 9, 10 and 11 are front views each showing another example of the clubhead main body.
Figure 10:
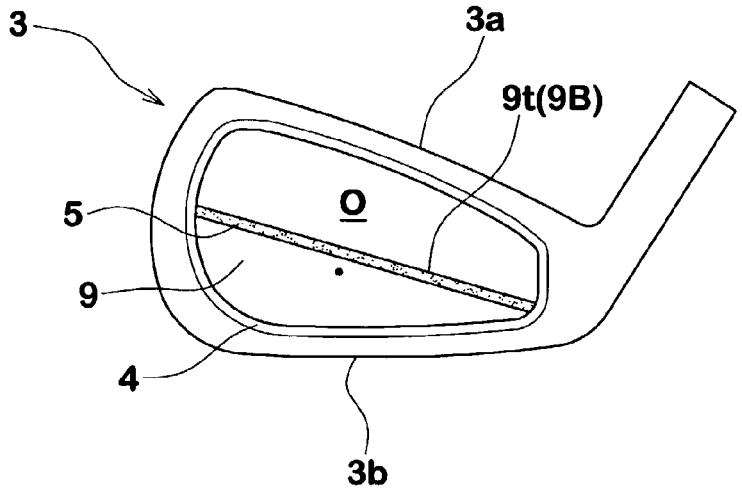
Figure 11:
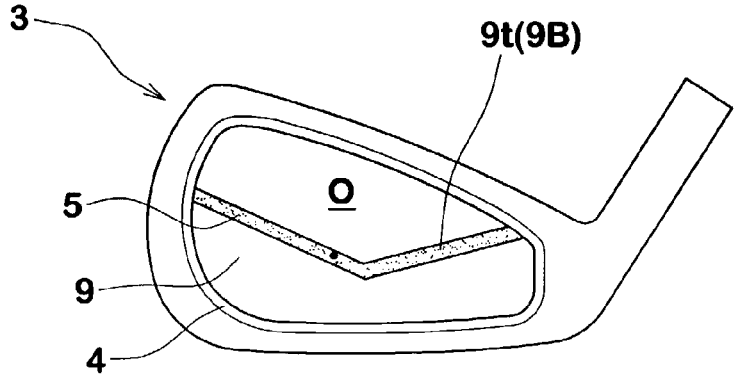

The backside wall 9 extends towards the upside from the sole portion 3*b*, while leaving a space between this backside wall 9 and the face plate 2. The backside wall 9 comprises a main part 9A extending almost uprightly from the rear end of the backward extension 3*f*, and an upper part 9B extending towards the face plate 2 from the upper edge of the main part 9A. The example of the upper part 9B shown in FIG. 5 is very small, but it may be formed to have a substantial dimension as shown in FIG. 7. In this embodiment, as shown in FIGS. 2, 3 and 8, the backside wall 9 has an arched shape, and a maximum height lies in its central part 9*a*, and the height progressively decreases from the central part 9*a* towards both the toe-side and heel-side ends 9*b*. Aside from the arched shape, various shapes may be employed as follows: a trapezoidal shape as shown in FIG. 9 where the hole (O) comes to on both sides thereof; a straight shape as shown in FIG. 10 where the upper edge is sloped from the toe to the heel in substantially parallel with the top portion 3*a*; and a reversed arched shape or V-shape as shown in FIG. 11. In any case, the backside wall 9 is generally shorter in height than the upper edge of the club face F.

Between the upper edge 9*t* of the backside wall 9 and the back surface 2*b* of the face plate 2, an elastic insert 5 is disposed.

The elastic insert 5 has dimensions capable of bridging a gap between the upper edge 9*t* and the back surface 2*b* and extending along the overall length of the upper edge 9*t*, thereby, the above-mentioned space is closed and a closed hollow (i) is formed behind a lower part of the face plate 2 whereas an upper part (r) of the face plate 2 is exposed through the hole (O). Not to heighten the center of gravity of the club head, the specific gravity of the elastic insert 5 is set to be smaller than that of the clubhead main body 3.

The elastic insert 5 is made of an elastic material. As the elastic material, a nonmetal material such as resin and rubber is preferably used. Specifically, resins such as ABS resin, epoxide resin, polyethylene resin, polypropylene resin, polyethylene terephthalate resin, polystyrene resin, polyurethane resin and thermoplastic elastomer; rubber compounds including at last one of natural rubber, styrene-butadiene rubber, butadiene rubber and nitrile rubber as its main component; and the like may used.

The elastic material has a Young's modulus in a range of less than 2500 MPa, preferably less than 1500 MPa, more preferably less than 500 MPa but more than 2 MPa and/or in a range of not more than 10%, preferably $1\times10^{-5}$ to 1%, more preferably $1\times10^{-5}$ to $2\times10^{-2}$% of the Young's modulus of the face plate 2.

Although the result depending on the material used, if the thickness T of the elastic insert 5 between the front end 9*t* of the backside wall 9 and the back face 2*b* of the face plate 2 is too small, the restitution coefficient of the clubface F tends to decrease because the flexure of the face plate 2 at impact is excessively restricted. If the thickness T is too large, it becomes difficult to control the frequency of the face portion. Therefore, the thickness T of the elastic material 5 between the upper edge or front end 9*t* of the backside wall 9 and the back face 2*b* of the face plate 2 is set in the range of less than 10.0 mm, preferably less than 5.0 mm, more preferably less than 3.0 mm, but more than 0.5 mm, preferably more than 1.0 mm.

If the contact area Sa of the elastic material 5 with the back face 2*b* is too narrow, it is difficult to control the frequency, and it becomes difficult to maintain the necessary strength. If the contact area Sa is too wide, the flexure of the face plate 2 at impact is excessively restricted, and the restitution coefficient is liable to decrease. Further, there is a possibility that the difference in rigidity between the lower part and upper part of the face portion becomes large to decrease the directionality. Therefore, the total contact area Sa of the insert 5 with the face plate back face 2*b* is preferably set in the range of from 50 to 500 sq.mm, more preferably 50 to 200 sq.mm.

With the similar view, the width D of the elastic material measured vertically along the face plate back face 2*b* is set in the range of from 2 to 10 mm, preferably 2 to 5 mm.

As shown in FIG. 5, the numerical value of the difference |Hmax−Hs| between a sweet spot height Hs and the maximum Hmax of a back support height H is set in the range of not more than 5 mm, wherein the back support height H is defined as the height H of a point P from the horizontal plane HP, the point P is an intersection between the club face F and a normal line C to the club face F passing the center of the width D of the insert 5, and the sweet spot height Hs is the height of the sweet spot SS from the horizontal plane HP, the sweet spot SS is a point of intersection between the club face F and a straight line drawn from the center of gravity G of the club head 1 normally to the club face F.

In the vertical plane or section (FIG. 5) passing through the sweet spot SS and being at a right angle to the club face F, the ratio (H/Ha) of the back support height H to the height Ha of the club head is preferably set in the range of from 0.2 to 0.8, preferably 0.3 to 0.5.

Further, on the club face F, the distance of the sweet spot SS from the locus of the point P described along the upper edge 9*t* is preferably set in the range of not more than 10 mm, more preferably not more than 5 mm, and roughly, the locus extends radially from the sweet spot SS as the center.

The elastic insert 5 is usually fixed to the backside wall 9 rather than the face plate 2, while being appressed to the face plate back face 2*b*. An adhesive agent or the like can be employed in fixing. But in this embodiment, a mechanical engagement between the backside wall 9 and the elastic material 5 is utilized.

In the example shown in FIG. 5, as the upper part 9B is relatively thick, the front end 9*t* of the backside wall 9 is provided along the entire length with a narrow groove 10*a*, and the elastic insert 5 is provided on the backside with a rib 10*b* press-fitting into the narrow groove 10*a*. In this example, the cross sectional shape of each of the groove 10*a* and rib 10*b* is a rectangle.

In another example shown in FIG. 7, as the upper part 9B is relatively thin, a narrow groove 10*a* is formed on the elastic insert 5, and the front end 9*t* of the backside wall 9 is press fitted into the narrow groove 10*a*.

Figure 6:
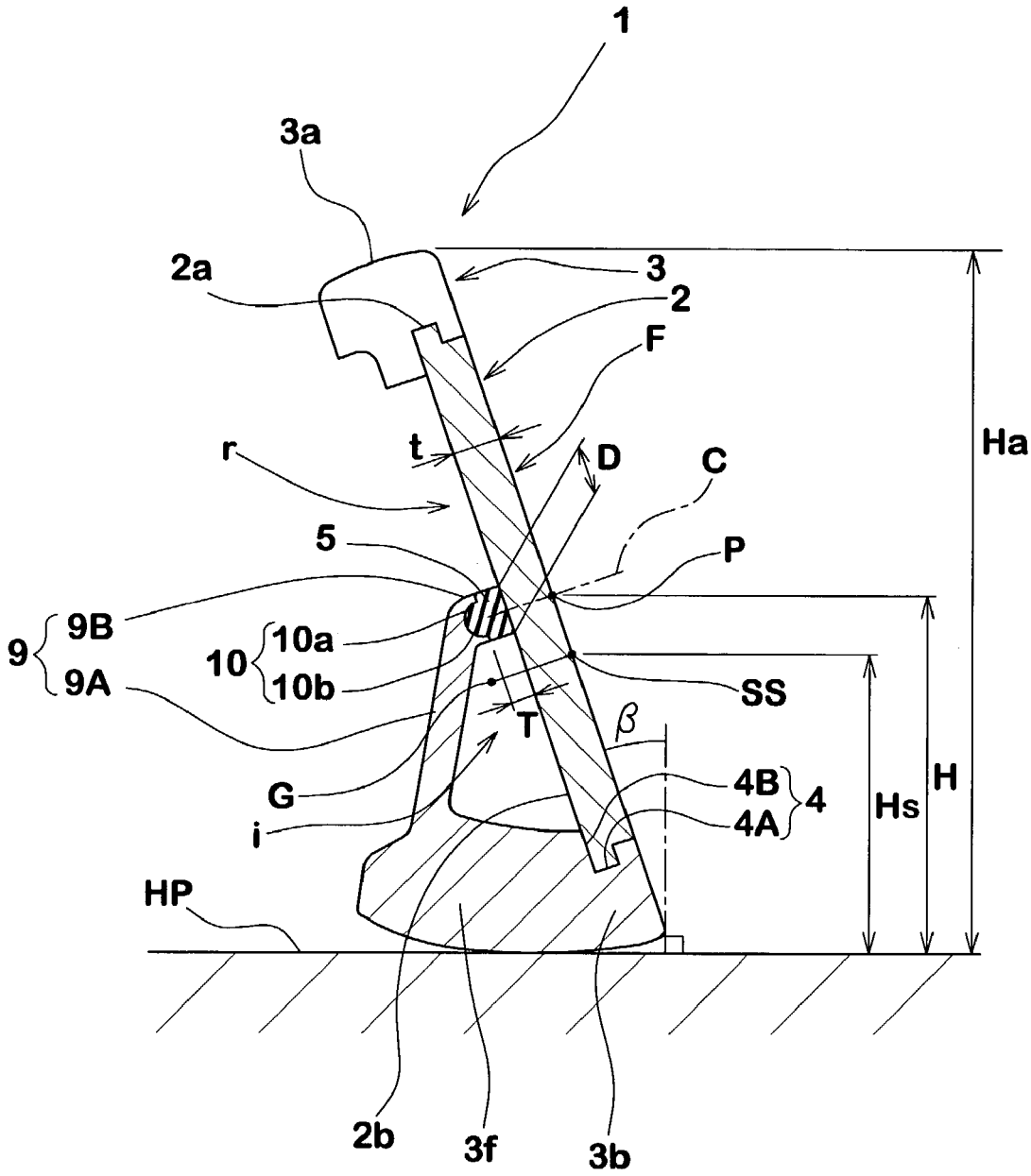
FIGS. 6 and 7 are sectional views each showing another embodiment of the present invention.

FIG. 6 shows a further example similar to the FIG. 3 example. In this example, in order to make the fitting of the insert 5 easier even after the face plate has been fixed to the clubhead main body, the cross sectional shapes of the groove 10*a* and rib 10*b* are rounded (arch, semicircle and the like are preferred).

It is of course possible to use an adhesive agent in the mechanical engagement part 10. It is also possible to use an adhesive agent between the back face 2*b* and elastic insert 5.

In the above-mentioned embodiments, the clubhead main body 3 inclusive of the backside wall 9 and backward extension 3*f* is an integral molding of a metal. But, the clubhead main body 3 may be made up of two or more pieces.

Comparison Tests

Club heads for number six (#6) iron were made to measure the natural frequency. Each of the clubhead main bodies was an integral molding of SUS630 formed by lost-wax precision casting. The thickness of each of the face plates was a constant value of 2.8 mm.

The natural frequency of the face portion was measured as follows. An acceleration pickup was attached to each of the club face and a vibrator, and with using a dynamic signal analyzer (model HP-5420A manufactured by YHP), the output signals of the pickups when the club face was vibrated at a variable frequency were processed and analyzed to obtain the primary natural frequency. The results are shown in Table 1.

TABLE 1

Figure 12:
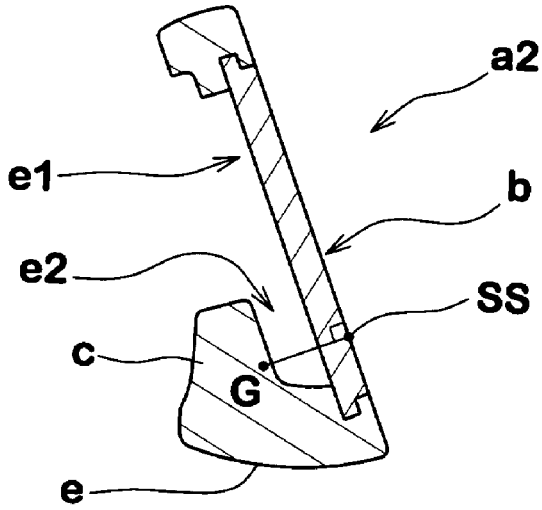
FIGS. 12 and 13 are cross sectional views of iron-type golf club heads used as comparative examples in the undermentioned comparison test.
Figure 13:
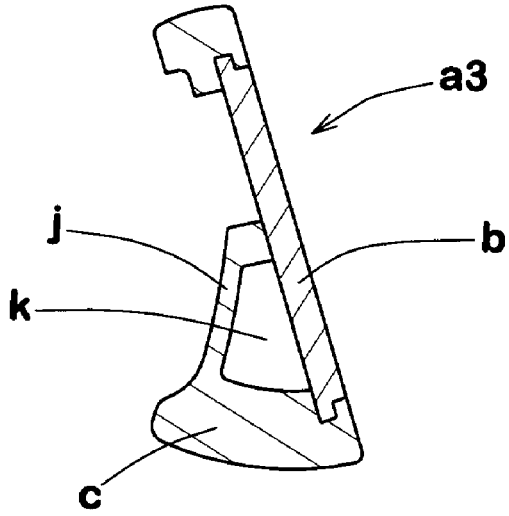

| Club Structure | Ref. 2 FIG. 13 | Ref. 1 FIG. 12 | Ex. 1 FIG. 5 | Ex. 2 FIG. 5 | Ex. 3 FIG. 5 | Ex. 4 FIG. 5 | Ex. 5 FIG. 5 | Ex. 6 FIG. 5 | Ex. 8 FIG. 5 | Ex. 9 FIG. 5 | Ex.7 FIG. 5 |
|---|---|---|---|---|---|---|---|---|---|---|---|
| Face plate | | | | | Ti-6AI-4V | | | | | | CUSTOM 465 |
| Material | | | | | 113000 | | | | | | 198000 |
| Young's modulus (MPa) | | | | | | | | | | | |
| Head main body | | | | | | SUS630 | | | | | |
| Material | | | | | | 180000 | | | | | |
| Young's modulus (MPa) | | | | | | | | | | | |
| Elastic body | — | — | epoxy | ABS | NR-based | BR-based | elastomer | | thermoplastic polyether ester | | |
| Material | | | | | rubber | rubber | resin | | elastomer | | |
| Young's modulus (MPa) | — | — | 2410 | 2200 | 5 | 4 | 330 | | 88 | | |
| Minimum thickness (mm) | — | — | 2 | 2 | 2 | 2 | 2 | 2 | 0.5 | 3 | 2 |
| Natural frequency (Hz) | 2060 | 1341 | 1361 | 1355 | 1341 | 1343 | 1360 | 1343 | 1420 | 1341 | 1380 |

From the test results, it was confirmed that the elastic insert can make a fine adjustment of the natural frequency of the club face without driving the frequency out of the natural frequency range of the balls.

As described above, in the golf club head according to the present invention, the backside wall is provided, and the elastic insert is disposed between the backside wall and the back face of the face portion. Therefore, the center of gravity of the club head becomes lower and deeper, and at the same time the natural frequency of the face portion can be easily adjusted to that of the golf balls without changing the face material or structure. Thus, the design freedman is greatly increased, and the manufacturing cast may be decrease.

Further, it is possible to completely prevent foreign objects such as dirt, water and grass, going into the space between the backside wall and the back face of the face plate by arranging the insert to completely close the space.

The present invention is suitably applied to an iron-type golf club head, but it is also possible to apply to utility-type club head, wood-type club head and the like as far as the face plate is mounted on the main body with the back face of the face plate being free of substantial support.

What is claimed is:

1. A golf club head comprising a face plate having a back face and a front face forming a club face for hitting a ball, a clubhead main body provided with a through hole to which the face plate is attached, the clubhead main body comprising a sole portion and a backside wall portion, the backside wall portion extending upward from the sole portion, leaving a space from said back face, and an insert made of an elastic material and interposed between the back face of the face plate and the backside wall portion, the elastic insert being in contact with the back face and the backside wall portion so that a closed hollow is formed behind a lower part of the face plate whereas an upper part of the face plate is exposed through said through hole.

2. A golf club according to claim 1, wherein said insert is disposed along a free edge of the backside wall portion and said space is substantially closed by the insert.

3. A golf club according to claim 1, wherein the Young's modulus of the insert is not more than 10% of the Young's modulus of the face plate.

4. A golf club according to claim 1, wherein the Young's modulus of the insert is not more than 2500 MPa.

5. A golf club according to claim 1, wherein the backside wall has a height gradually decreasing towards the heel and toe of the head.

6. A golf club according to claim 1, wherein the backside wall has a height gradually decreasing towards the heel and toe of the head, and the backside wall has an arched shape.

7. A golf club according to claim 1, wherein the backside wall has a height gradually decreasing towards the heel and toe of the head, and the backside wall has a trapezoidal shape.

8. A golf club head comprising a face plate having a back face and a front face forming a club face for hitting a ball, and a clubhead main body to which the face plate is attached, said clubhead main body comprising a sole portion and a backside wall portion, said backside wall portion extending upward from the sole portion, leaving a space from said back face, so as to have a free edge facing the back face, said free edge provided with a groove extending along the length thereof to secure an elastic insert interposed between the back face and the backside wall portion.

9. A set of elastic inserts for use in a golf club head as set forth in claim 8, wherein the elastic inserts have different Young's moduli in a range of not more than 2500 MPa.

10. A set of a golf club head and elastic inserts, the golf club head comprising a face plate having a back face and a front face forming a club face for hitting a ball, and a clubhead main body to which the face plate is attached, said clubhead main body comprising a sole portion and a backside wall portion, said backside wall portion extending upward from the sole portion, leaving a space from said back face, so as to have a free edge facing the back face, said free edge provided with a groove extending along the length thereof to secure an elastic insert interposed between the back face and the backside wall portion, and the elastic inserts having different Young's moduli in a range of not more than 2500 MPa.

11. A method of adjusting the natural frequency of a face portion of a golf club head to a natural frequency of a golf ball, the golf club head comprising a main body and a face plate attached thereto to form said face portion, said method comprising providing the main body with a face plate mount to support the face plate while keeping a back face of the face plate free, providing a backside wall portion extending upward from a sole portion of the main body, leaving a space from the back face of the face plate, providing an insert out of an elastic material having a Young's modulus of not more than 2500 MPa, disposing the insert between the back face of the face plate and the backside wall portion so that the elastic insert contacts with the back face partially and the backside wall portion such that a hollow is formed behind a lower part of the face plate whereas an upper part of the face plate is exposed through a through hole of the main body, and a distance between the insert projected onto the front face and a sweet spot of the club head on the front face is not more than 10 mm.

12. A method of adjusting a natural frequency of a face portion of a golf club head to a natural frequency of a golf ball, the golf club head comprising a face plate forming said face portion, and a backside wall spaced apart from a back face of the face plate, said method comprising providing an insert out of an elastic material having a Young's modulus of not more than 2500 MPa, and disposing the insert between the back face of the face plate and the backside wall portion so that the elastic insert contacts with the back face partially and the backside wall portion such that a hollow is formed behind a lower part of the face plate whereas an upper part of the face plate is exposed through a through hole of the main body, and a distance between the insert projected onto the front face and a sweet spot of the club head on the front face is not more than 10 mm, wherein said process of providing the insert includes selecting a Young's modulus value in order to adjust the natural frequency of the face portion to that of a golf ball.

13. A method of adjusting the natural frequency of a face portion of a golf club head to a natural frequency of a golf ball, the golf club head comprising a main body and a face plate attached thereto to form said face portion, said method comprising providing the main body with a face plate mount to support the face plate while keeping a back face of the face plate free, providing a backside wall portion extending upward from a sole portion of the main body, leaving a space from the back face of the face plate, providing an insert out of an elastic material having a Young's modulus of not more than 2500 MPa, disposing the insert between the back face of the face plate and the backside wall portion so that the elastic insert contacts with the back face partially and the backside wall portion such that a closed hollow is formed behind a lower part of the face plate whereas an upper part of the face plate is exposed through a through hole of the main body, and a distance between the insert projected onto the front face and a sweet spot of the club head on the front face is not more than 10 mm.

14. A method of adjusting a natural frequency of a face portion of a golf club head to a natural frequency of a golf ball, the golf club head comprising a face plate forming said face portion, and a backside wall extending upward from a sole portion and spaced apart from a back face of the face plate, said method comprising providing an insert out of an elastic material having a Young's modulus of not more than 2500 MPa, and disposing the insert between the back face of the face plate and the backside wall portion so that the elastic insert contacts with the back face partially and the backside wall portion such that a closed hollow is formed behind a lower part of the face plate whereas an upper part of the face plate is exposed through a through hole of the main body, and a distance between the insert projected onto the front face and a sweet spot of the club head on the front face is not more than 10 mm, wherein said process of providing the insert includes selecting a Young's modulus value in order to adjust the natural frequency of the face portion to that of a golf ball.

* * * * *